US005659909A

United States Patent [19]

Pfeuffer et al.

[11] Patent Number: 5,659,909

[45] Date of Patent: Aug. 26, 1997

[54] OPERATING TABLE PATIENT SUPPORT MEANS

[75] Inventors: Reinhard Pfeuffer, Eichesheim-Illingen; Klaus Bock, Kuppenheim, both of Germany

[73] Assignee: Maquet AG, Rastatt, Germany

[21] Appl. No.: 495,940

[22] Filed: Jun. 28, 1995

[30] Foreign Application Priority Data

Jul. 4, 1994 [DE] Germany ..... 44 23 375.2

[51] Int. Cl.[6] ..... A61G 13/00

[52] U.S. Cl. ..... 5/600; 5/611; 5/613; 5/617; 5/618

[58] Field of Search ..... 5/600, 611, 616, 5/618, 601, 613, 617; 74/89.17

[56] References Cited

U.S. PATENT DOCUMENTS

| | | | |
|---|---|---|---|
| 3,980,288 | 9/1976 | Mitchell et al. | 5/601 |
| 4,101,120 | 7/1978 | Seshima | 5/611 |
| 4,225,125 | 9/1980 | Lee | 5/618 |
| 4,575,064 | 3/1986 | Menor | 5/600 |
| 5,210,893 | 5/1993 | Uosaki et al. | 5/601 |
| 5,390,557 | 2/1995 | Tsukada | 74/89.17 |
| 5,403,146 | 4/1995 | Jones | 74/89.17 |

*Primary Examiner*—Rodney M. Lindsey
*Assistant Examiner*—Frederick Conley
*Attorney, Agent, or Firm*—McCormick, Paulding & Huber

[57] ABSTRACT

A patient support means (16) of an operating table comprises several patient support sections (18,20,22,24) connected to one another and in the region of one of the sections is releasably connected with a support apparatus (10). The support section (18) connectable with the support apparatus (10) includes a lower plate portion (30) couplable with the support apparatus and an upper plate portion (32) translationally adjustably guided on the lower plate portion and connected with the remaining sections (20,22,24) of the patient support means (16), with the lower plate portion (30) being made in the form of a closed box in which the drive mechanism for the adjustment of the upper plate portion (32) is arranged.

11 Claims, 3 Drawing Sheets

OPERATING TABLE PATIENT SUPPORT MEANS

FIELD OF THE INVENTION

The invention concerns an operating table patient support means which is made of several support sections connected with one another and which in the area of one of these sections is releasably connectable with a support apparatus.

BACKGROUND OF THE INVENTION

Patient support means of the above-mentioned kind are known the sections of which are pivotal relative to one another about transverse axes by motors arranged in the rails of the patient support means. For certain purposes it is however also desirable to make possible a translational adjustment of the patient support means relative to the supporting apparatus, in order for example to be able to shift certain body parts of the patient into the reach of an X-ray device or other stationary apparatus during an operation without having to take the patient support means off of the support apparatus. In all kinds of adjusting apparatus there exists the problem that they must work reliably and must represent no danger to the patient or the operator, and at the same time must be convenient and reliable to clean so that they can fulfill the sterility requirements of an operating room.

The invention has as its object the provision of a patient support means of the aforementioned type which, taking into consideration the previously mentioned requirements, is translationally adjustable relative to a support apparatus.

SUMMARY OF THE INVENTION

The object of the invention is solved in that the section of the patient support means connectable with the support apparatus includes a lower plate portion couplable with the support apparatus and an upper plate portion translationally adjustably guided on the lower plate portion, which upper plate portion is connected with the remaining sections of the patient support means, and in that the lower plate portion is made in the form of a closed box in which a drive mechanism is arranged for the adjustment of the upper plate portion.

With this solution of the invention the mechanism for the translational adjustment of the patient support means relative to the support apparatus is arranged entirely within the patient support means. Thereby coupling elements between the patient support means and the support apparatus for translational adjustment of the patient support means relative to the support apparatus, and with it the associated hygienic problems, are avoided. When the patient support means is connected to the support apparatus only a connection for transmitting driving energy, and if need be control signals, between the supporting apparatus and the patient support means need be provided. Meshing mechanical elements for transmitting a drive motion on the other hand are not necessary. The adjusting apparatus is an entirely enclosed unit inside the patient support means and is not involved in the separation between the patient support means and the support apparatus.

Preferably the drive mechanism includes an electric motor connected with a transmitting mechanism arranged in the lower plate portion for transmitting electrical energy between the patient support means and the support apparatus. One such transmitting apparatus can for example include electric contact elements which upon setting of the patient support means onto the support apparatus come into contact with corresponding contact elements in the support apparatus.

The upper plate portion is preferably rigidly connected with at least one drive element guided in the lower plate portion and which inside of the lower plate portion stands in driving engagement with a drive element driven by the electric motor. Therefore, to provide an easy to clean form of the patient support means it is only necessary to guide the drive element connected with the upper plate portion Out of the box shaped lower plate portion in a sealed manner. For this purpose suitable sealing elements are known.

According to a preferred embodiment the drive element is formed as a rack which meshes with a drive pinion inside of the lower plate portion. Such a shiftable rack inside of the lower plate portion can with relatively no problem be sealingly guided out of the lower plate portion. Practically the drive of the patient support surface relative to the support apparatus takes place in a symmetric way in that the upper plate portion has longitudinal rails connected through a transverse strut, each of which rails is connected with a rack guided in the lower plate portion.

Further advantageous developments of the invention are mentioned in the dependent claims. Other features and advantages of the invention are apparent from the following description which in connection with the accompanying drawings explains the invention in connection with an exemplary embodiment.

DETAILED DESCRIPTION OF THE PREFERRED EMBODIMENT

Figure 1:
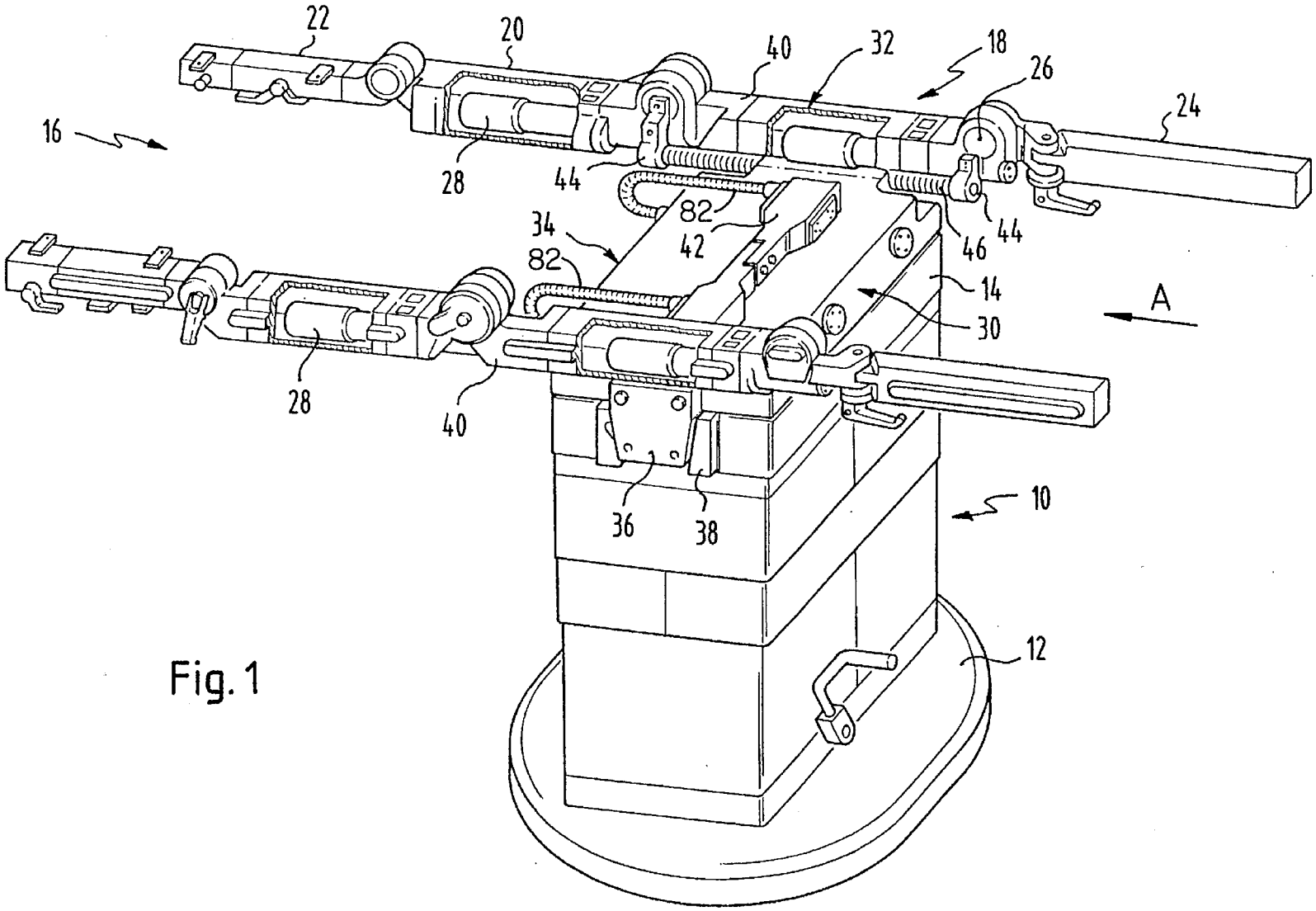
FIG. 1—a partially schematic representation of a patient support means embodying the invention which is mounted on the support column of an operating table, with the support cushioning being omitted, FIG. 2—a partially sectional end view of the lower plate portion alone taken in the direction of the arrow A of FIG. 1, FIG. 3—a horizontal section taken through the lower plate portion along the line III—III of FIG. 2, and FIG. 4—a partial sectional view taken along the line IV—IV of FIG. 3.
Figure 2:
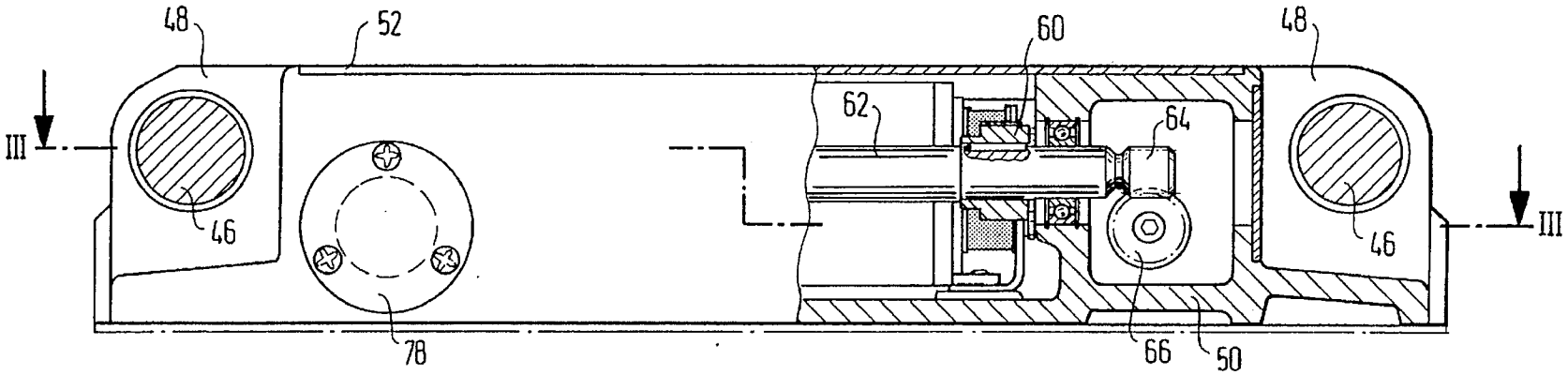
Figure 4:
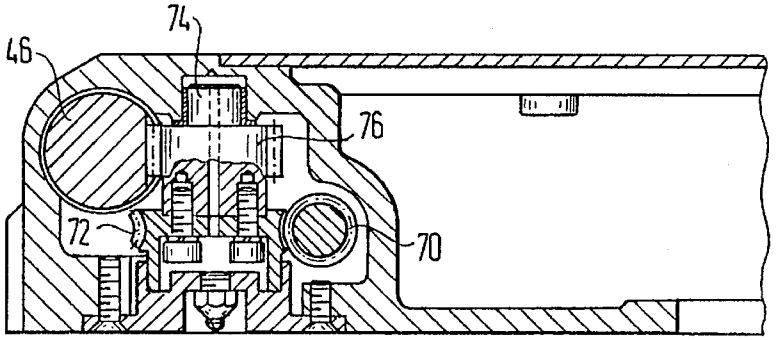
Figure 3:
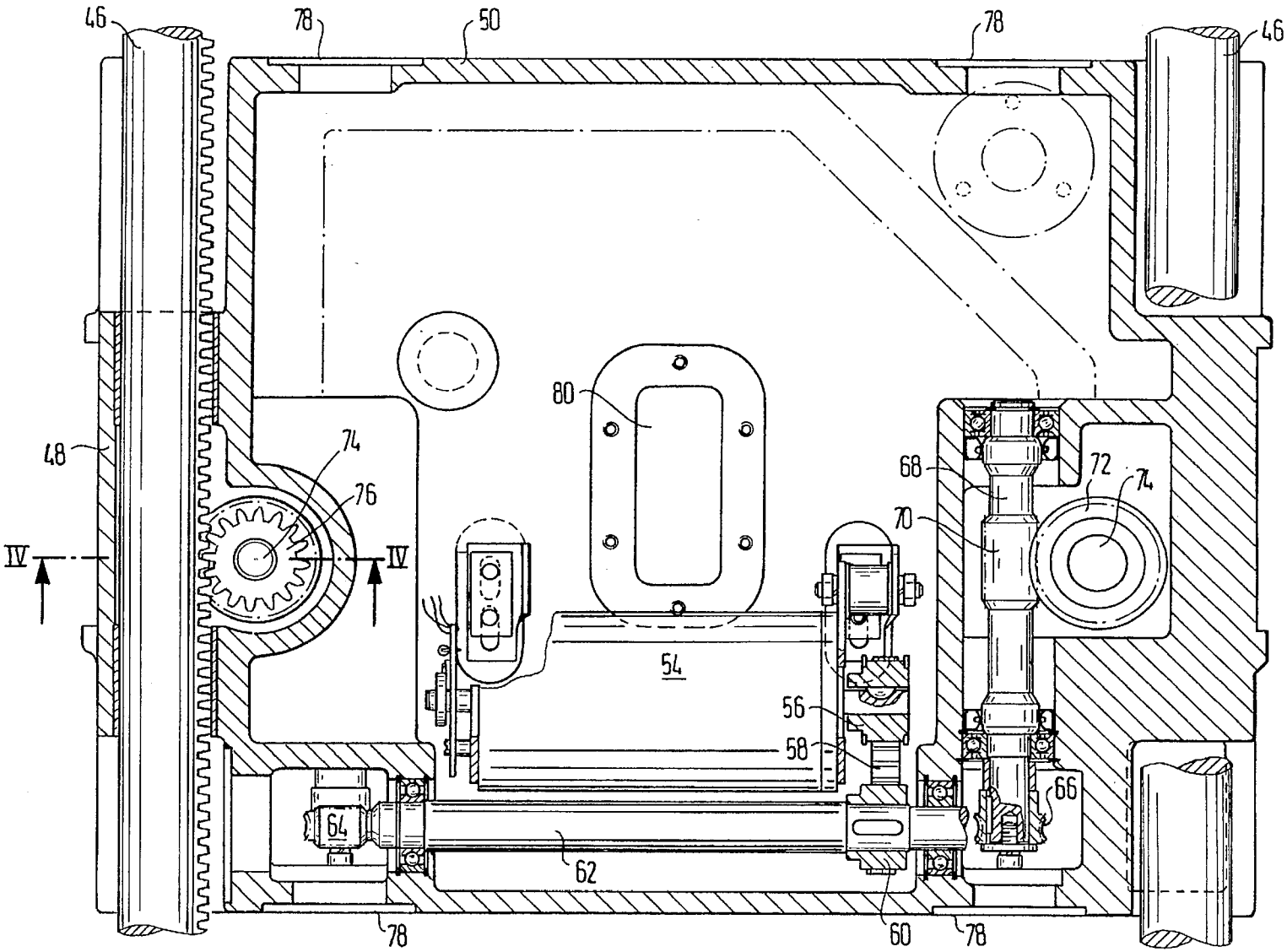

The operating table illustrated schematically in FIG. 1 includes a support column 10 with a column foot 12 and a head portion 14, as well as a patient support means 16 connected with the head portion 14 of the support column 12, with the cushioning of the patient support means being omitted to provide a better view.

The patient support means 16 comprises a middle section, indicated generally at 18, connected with the head portion 12 of the supporting column 10 and to which on both sides further patient support sections 20, 22 and 24 are connected which are pivotal relative to one another about horizontal axes 26. The pivoting takes place with the help of motors 28 which are arranged in the rails of the patient support sections. Since these adjusting drives are known in themselves and are not essential to the present application they are not explained in greater detail.

The middle section 18 of the patient support means 16 includes a lower plate portion 30 as well as an upper plate portion 32, which upper plate portion 32 is adjustable relative to the lower plate portion 30 parallel to the direction of the arrow A of FIG. 1. The lower plate portion 30 includes a closed housing 34 in the form of a flat parallelpiped block. A pin shaped connecting element 36 is connected to each of two oppositely disposed side surfaces of this housing and is suited to be received in a complementary pin receiver 38 arranged on the column head 14. By means of a detent mechanism (not illustrated in more detail) on the connecting element 36 the lower plate 30 and with it the entire patient support means 16 can be latched onto the support column 10.

The upper plate portion 32 is made of an H-shaped frame with two side rails 40 and an intermediate cross strut 42 which connects the two side rails 40. The free ends of each of the rails 40 carry, by means of fastening elements 44 on the associated inner sides of the rail, a rack 46 running parallel to the associated rail and which passes through a housing section 48 of the lower plate portion and is sealingly guided through the corresponding openings of the housing section 48. With the help of these racks the upper plate portion 32 is shiftably guided on the lower plate portion 34; and by means of an adjusting drive arranged inside of the lower plate portion 34 the upper plate portion is adjustable parallel to the direction of the arrow A, as will now be explained in further detail.

The lower plate portion 34 has a box shaped housing lower portion 50 which is closable on its upper side by a cover 52. On each of two opposite sides of the housing lower portion 50 a guide 48 for one of the racks 46 is formed. An electric motor 54 is arranged in the box shaped housing lower portion 50, which electric motor through a pinion 56 on its drive shaft and a toothed belt 58 drives a shaft 62 provided with a pinion 60, which shaft 62 is freely rotatably supported in the housing lower portion 50 perpendicular to the shifting direction of the racks 46. The shaft 62 on each of its two ends carries a worm 64 which meshes with a worm gear 66 which in turn is fastened to a shaft 68 freely rotatably supported in the housing lower portion parallel to one of the racks 46. This shaft 68 carries a further worm 70 at its middle section which worm meshes with a worm gear 72 positioned on a shaft 74 perpendicular to the cover 52 of the lower plate portion. This shaft 74 is likewise supported in the housing lower portion 50 and carries a gear 76 which meshes with the associated one of the racks 46. The drive connections between the motor 54 and the two racks 46 are made entirely symmetrical so that the two racks 46 are adjusted synchronously by the motor 54. For assembly and maintenance purposes openings are provided in the housing lower portion 50 in the area of the worm drives 64,66, which openings are closable by covers 78.

The patient support means associated portion 80 of a connecting or transmitting module is installed in the bottom of the housing lower portion 50, through which module a wireless connection for the transmission of electrical drive energy and information signals between the support column 10 and the patient support means 16 can take place. Inside of the lower plate portion 30 is a nonillustrated control unit which is connected with a control unit in the upper plate portion 32 through cables 82. Through these cables also flow the currents for the electric motors 28 which serve for the adjustment of the patient support sections 20 to 24 relative to the middle section 18.

The foregoing description shows that in the patient support means of the invention all adjusting apparatus, including that for a translational horizontal adjustment of the patient support means, is arranged inside of the patient support means. Therefore it is possible to adjust and control all movement functions at the patient support means independently of whether the patient support means is arranged on the support column of the operating table or on a transport wagon or on some other supporting apparatus, provided that the patient support means receives the necessary energy as well as, as the case may be, the necessary control signals for the drive of the electric motors arranged in it. Since no mechanical drive elements need be coupled with the patient support means the contact surfaces of the patient support means as well as those of the support apparatus can easily be cleaned.

We claim:

1. A patient support means (16) for an operating table, which operating table includes a support apparatus (10), said patient support means comprising:

a number of support sections (18,20,22,24) connected with one another with one (18) of said sections being releasably connectable with said support apparatus (10), said support section (18) connectable with the support apparatus (10) including a lower plate portion (30) couplable with the support apparatus and an upper plate portion (32) translationally adjustably guided on the lower plate portion, said upper plate portion being connected with the remaining sections (20,22,24) of the patient support means, said lower plate portion (30) being made in the form of a sealed closed box (50,52) in which is arranged a drive mechanism (54) for the adjustment of the upper plate portion (32), said drive mechanism including an electric motor (54) connected with a transmitting device (80) in the bottom of said closed box (50,52) for transmitting electrical energy between the patient support means (16) and the support apparatus (10) when the patient support means is connected with the support apparatus, and said transmitting device having no wires connected between said patient support means (16) and said support apparatus (10) so that when said support means (16) is removed from said support apparatus (10) said support means becomes completely disconnected from said support apparatus (10).

2. A patient support means according to claim 1 characterized in that the upper plate portion (32) is rigidly connected with at least one elongated drive element (46) which is guided in the lower plate portion (30), said elongated drive element (46) having a first portion located outside of said closed box and rigidly connected with said upper plate portion and a second portion located inside of said closed box and drivingly connected with said and inside of the lower plate portion (30) meshes with a drive element (76) driven by the electric motor (54) for translationally adjusting said upper plate portion relative to said lower plate portion.

3. A patient support means according to claim 2 characterized in that the drive element is formed as a rack (46) which meshes with a drive pinion (76) inside of the lower plate portion (30).

4. A patient support means according to claim 3 characterized in that the upper plate portion (32) has two longitudinal rails (40) connected by a cross strut (42) each of which rails is connected to a respective one of the racks (46) in the lower plate portion (30).

5. A patient support means according to claim 2 characterized in that said elongated drive element (46) is sealingly guided through an opening in said box.

6. A patient support means according to claim 1 further characterized in that positioning drives (28) for pivoting the support sections (20,22,24) relative to one another are arranged in the support sections (18,20) and in that the lower and upper plate portions (30,32) are connected by means (82) for transmitting energy for the positioning drives (28) from said lower plate portion to said upper plate portion.

7. A patient support means according to claim 6 characterized in that a control mechanism for controlling the adjusting drives (28) is arranged in said closed box and in that means (82) for transmitting information signals between said closed box and said upper plate portion are provided.

8. A patient support surface according to claim 1 further characterized in that said transmitting device (80) also serves for the transmission between the support apparatus (10) and the patient support means (16) of electrical energy for said positioning drives (28) of the patient support means and of information signals.

9. A patient support means (16) for an operating table, which operating table includes a support apparatus (10), said patient support means comprising:

a number of support sections (18,20,22,24) connected with one another with one (18) of said sections being releasably connectable with said support apparatus (10), said support section (18) connectable with the support apparatus (10) including a lower plate portion (30) couplable with the support apparatus and an upper plate portion (32) translationally adjustably guided on the lower plate portion, said upper plate portion being connected with the remaining sections (20,22,24) of the patient support means, said lower plate portion (30) being made in the form of a closed sealed box (50,52) in which is arranged a drive mechanism (54) for the adjustment of the upper plate portion (32), said upper plate portion (32) being rigidly connected with at least one elongated drive element (46) which is guided in the lower plate portion (30), and said elongated drive element (46) having a first portion located outside of said closed box and rigidly connected with said upper plate portion and a second portion located inside of said closed box and drivingly connected with said drive mechanism (54) for translationally adjusting said upper plate portion relative to said lower plate portion.

10. A patient support means according to claim 9, characterized in that the drive element is formed as a rack (46) which meshes with a drive pinion (76) inside of said closed box.

11. A patient support means according to claim 10 characterized in that said elongated drive element (46) is sealingly guided through an opening in said box.

* * * * *